US008449099B2

(12) United States Patent
Shiohara

(10) Patent No.: US 8,449,099 B2
(45) Date of Patent: May 28, 2013

(54) RECORDING APPARATUS

(75) Inventor: Satoru Shiohara, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 543 days.

(21) Appl. No.: 12/620,667

(22) Filed: Nov. 18, 2009

(65) Prior Publication Data

US 2010/0141725 A1 Jun. 10, 2010

(30) Foreign Application Priority Data

Dec. 10, 2008 (JP) ..... 2008-314469

(51) Int. Cl.
*B41J 2/01* (2006.01)

(52) U.S. Cl.
USPC ..... 347/102; 347/101; 347/103; 347/104

(58) Field of Classification Search
USPC ..... 347/101–104
See application file for complete search history.

(56) References Cited

U.S. PATENT DOCUMENTS 6,428,158 B1 * 8/2002 Szlucha ..... 347/102
6,530,115 B2 * 3/2003 MacNeil ..... 15/316.1
6,824,264 B2 * 11/2004 Shima et al. ..... 347/102
7,500,745 B2 * 3/2009 Ushirogouchi et al. ..... 347/102
2005/0257738 A1 11/2005 Tateishi et al.
2006/0221122 A1 * 10/2006 Kwon et al. ..... 347/30
2006/0274136 A1 * 12/2006 Ushirogouchi et al. ..... 347/102
2008/0012894 A1 * 1/2008 Ono ..... 347/21
2009/0272321 A1 11/2009 Tateishi et al.
2012/0026263 A1 * 2/2012 Chiwata ..... 347/101

FOREIGN PATENT DOCUMENTS

CN 1699058 A 11/2005
JP 08-001924 1/1996
JP 09-031829 2/1997
JP 2001-334647 A 12/2001
JP 2002-292841 10/2002
JP 2008-273663 11/2008

* cited by examiner

*Primary Examiner* — Ryan Lepisto
*Assistant Examiner* — Guy Anderson
(74) *Attorney, Agent, or Firm* — Workman Nydegger

(57) ABSTRACT

Provided is a recording apparatus including: a recording unit for performing recording on a recordable medium; a transportation unit for transporting the recordable medium; and a drier for accelerating the drying of the recordable medium by ejecting gas to the recordable medium, wherein the drier is configured such that the ejection range of the gas in a direction perpendicular to the transportation direction of the recordable medium is changeable.

4 Claims, 4 Drawing Sheets

RECORDING APPARATUS

BACKGROUND

1. Technical Field

The present invention relates to a recording apparatus such as a facsimile machine or a printer, and more particularly, to a recording apparatus including a drier for accelerating the drying of a recordable medium.

2. Related Art

Hereinafter, a printer will be described as an example of a recording apparatus. In particular, as described in Japanese Patent No. 3075329, there is provided a printer for heating a recording sheet by a heater, evaporating moisture included in the recording sheet, and exhausting air including moisture by an exhauster. JP-A-2002-292841 discloses a printer including a drier for drying an ink landing on a sheet by ejecting hot air onto the sheet.

Even when the heater and the exhauster are included in order to accelerate the drying of the sheet as in the printer described in Japanese Patent No. 3075329 or even when hot air is ejected onto the sheet as in the printer described in JP-A-2002-292841, turbulence (turbulent flow) of air stream occurs at the periphery of the sheet. If the turbulent flow occurs at an end of the sheet, floating (curling) of the end of the sheet occurs and thus recording quality may deteriorate. Such a technical problem is not sufficiently considered in the existing printers including the printers of Japanese Patent No. 3075329 and JP-A-2002-292841.

SUMMARY

An advantage of some aspects of the invention is that suitable recording quality is attained by preventing turbulence of air stream from occurring at an end of a sheet and preventing the end of the sheet from floating (curling).

According to an aspect of the invention, there is provided a recording apparatus including: a recording unit for performing recording on a recordable medium; a transportation unit transporting the recordable medium; and a drier accelerating the drying of the recordable medium by ejecting gas onto the recordable medium, wherein the drier is configured such that the ejection range of the gas in a direction perpendicular to the transportation direction of the recordable medium is changeable.

According to the present aspect, since the recording device includes the drier accelerating the drying of the recordable medium by ejecting the gas onto the recordable medium and the drier is configured such that the ejection range of the gas in the direction (hereinafter, referred to as "the width direction of the recordable medium") perpendicular to the transportation direction of the recordable medium is changeable, the ejection range can be adjusted according to the width of the recordable medium.

That is, for example, if the ejection range is large with respect to the width of the recordable medium, turbulent flow occurring in the side end of the recordable medium and thus the side end is apt to float (curl). However, since the ejection range can be adjusted according to the width of the recordable medium, it is possible to prevent the side end of the recordable medium from floating (curling) by the turbulent flow. In addition, it is possible to prevent the temperature of the heated recordable medium from being reduced by the turbulent flow.

The drier forms air stream from the center to the side end of the recordable medium in the direction perpendicular to the transportation direction of the recordable medium.

By this configuration, since the drier forms the air stream from the center to the side end of the recordable medium in the direction perpendicular to the transportation direction of the recordable medium, the gas escapes outwardly straight. Accordingly, it is possible to efficiently prevent the side end of the recordable medium from floating (curling) by the gas ejected from the drier.

In addition, after the gas is ejected onto the recordable medium, it is possible to reduce the distance of the gas moved to the outside of the recordable medium. Accordingly, when moisture is emitted from the recordable medium, it is possible to rapidly separate air including moisture from the recordable sheet, to suppress air including moisture from being moved to the downstream side even when the recordable sheet is transported at a high speed, and to prevent the recording unit (for example, an ink jet recording head) or the peripheral configuration thereof from bedewing with certainty.

In an air ejection port of the drier, a shutter member covering both sides of an ejection port in the direction perpendicular to the transportation direction may be displaceably provided in the direction perpendicular to the transportation direction, and the shutter member may be displaced such that the ejection range is changed.

By this configuration, since the shutter member which is displaceable in the width of the recordable medium is displaced such that the ejection range is changed, it is possible to configure the drier, in which the ejection range is changed, with low cost.

The drier may include a plurality of blast sources in the direction perpendicular to the transportation direction, and at least some of the plurality of blast sources may be displaced in the direction perpendicular to the transportation direction such that the ejection range is changed.

By this configuration, since the plurality of blast sources is included, at least some of the blast sources are displaceable in the width direction of the recordable medium. Since the blast sources are displaced such that the ejection range is changed, it is possible to adjust the gas ejection strength of the blast sources. Accordingly, it is possible to prevent the side end of the recordable medium from floating with more certainty, that is by setting the gas ejection strength from the blast sources disposed at the end of the recordable medium in the width direction to be strong.

BRIEF DESCRIPTION OF THE DRAWINGS

The invention will be described with reference to the accompanying drawings, wherein like numbers reference represent like elements.

DESCRIPTION OF EXEMPLARY EMBODIMENTS

Hereinafter, the embodiments of the invention will be described with reference to the accompanying drawings. FIG.

Figure 1A:
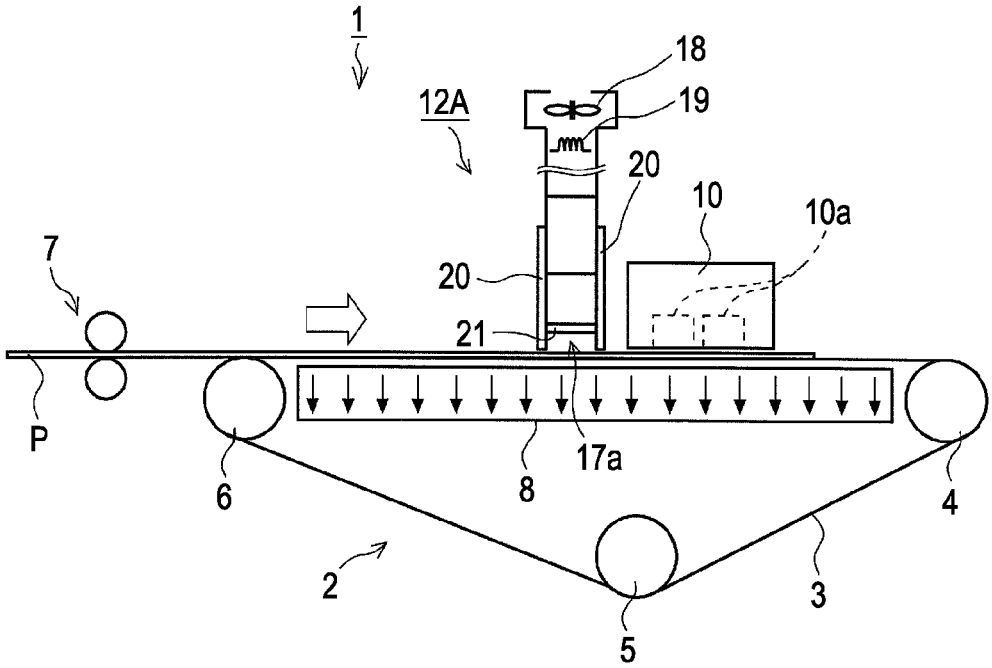
FIG. 1A is a side view showing the main portions of a printer according to a first embodiment of the invention and FIG. 1B is a plan view thereof.
Figure 1B:
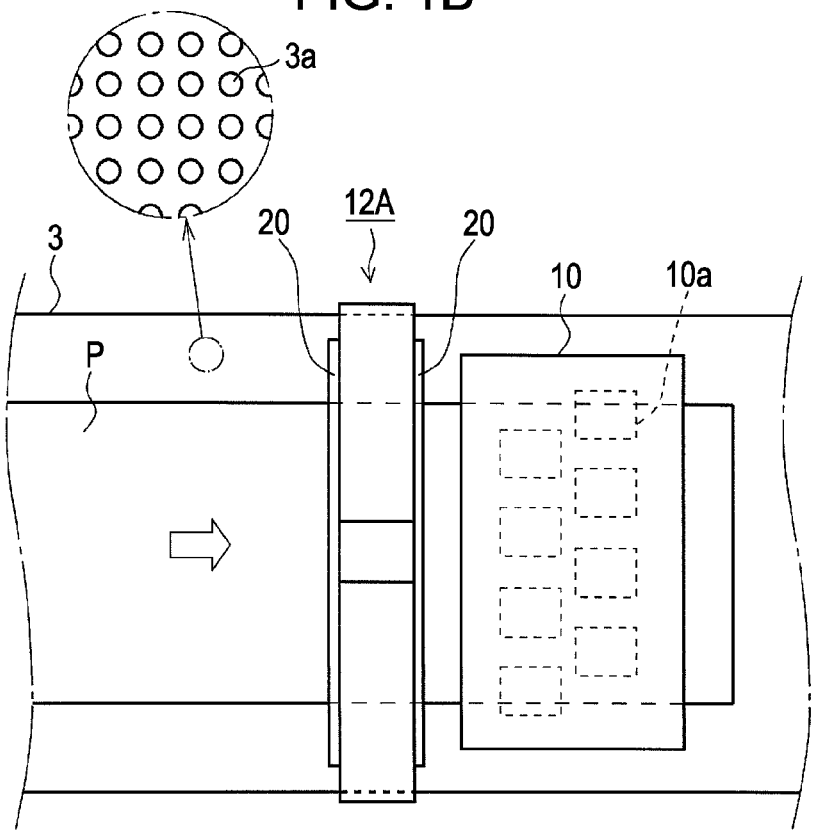
Figure 2:
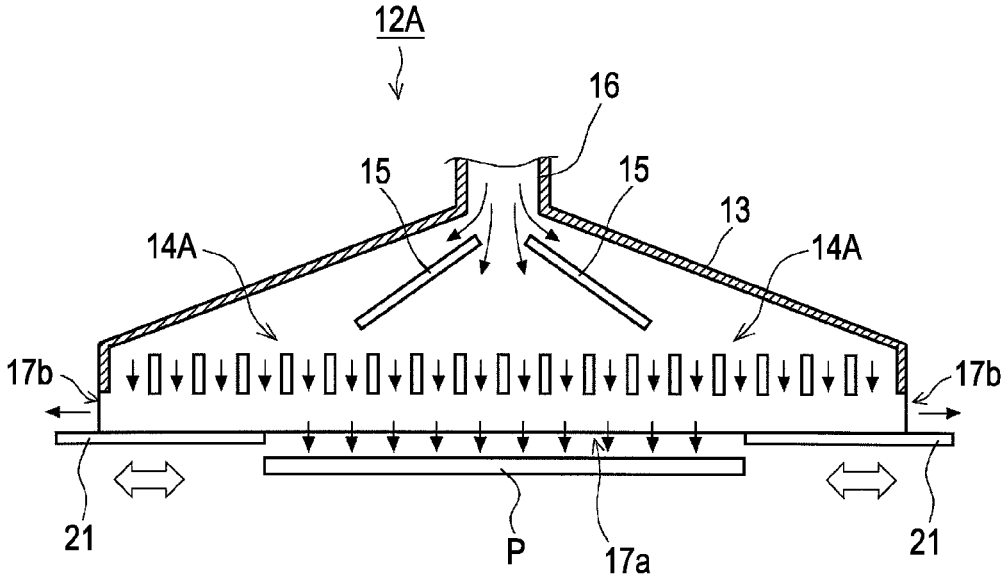
FIG. 2 is a cross-sectional view of a drier (first embodiment).
Figure 3:
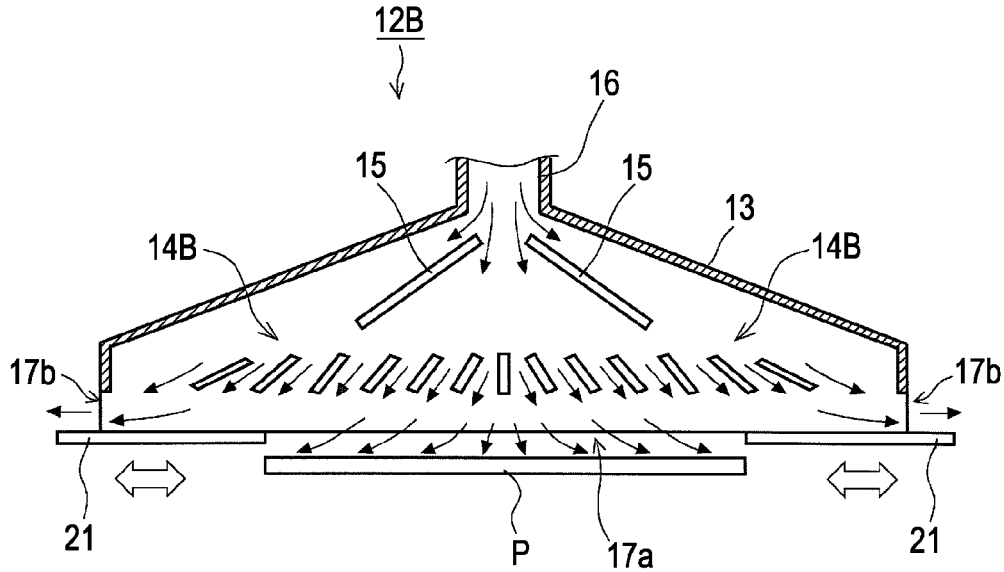
FIG. 3 is a cross-sectional view of a drier (second embodiment).
Figure 4:
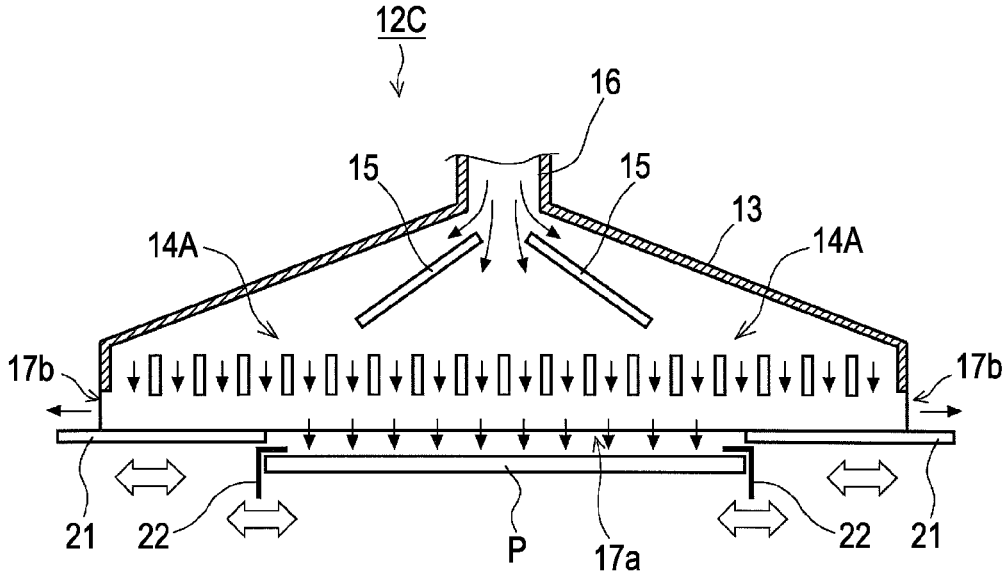
FIG. 4 is a cross-sectional view of a drier (third embodiment).
Figure 5:
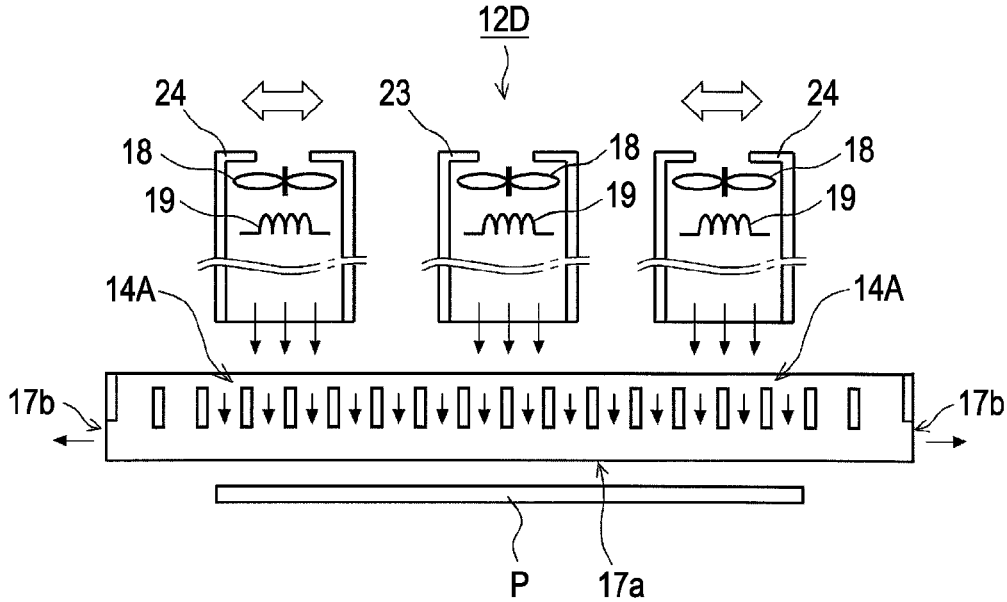
FIG. 5 is a cross-sectional view of a drier (fourth embodiment).
Figure 6A:
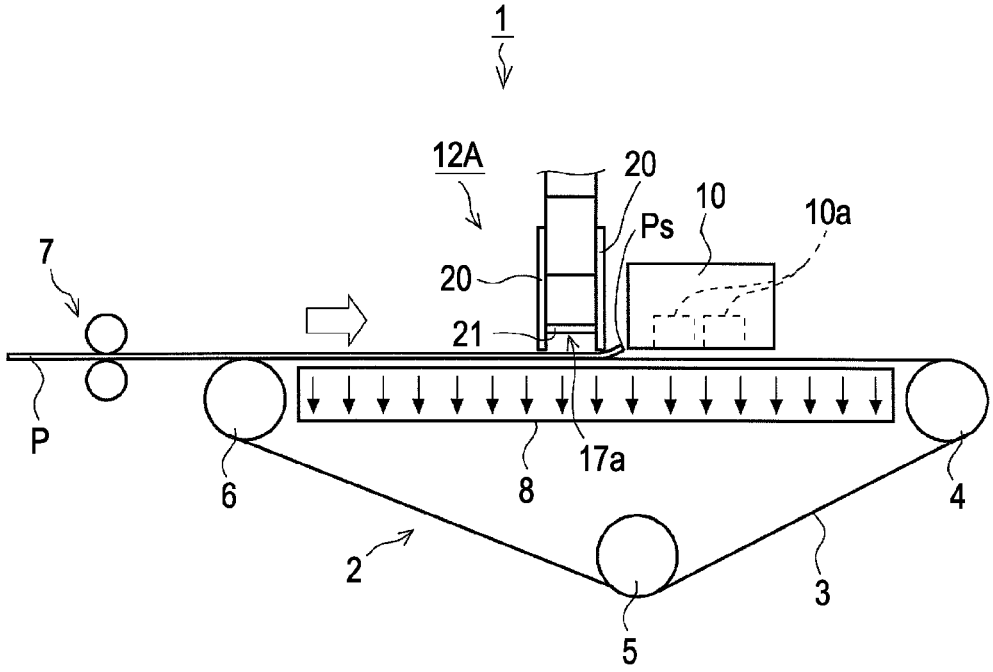
FIG. 6A is a side view showing the main portions of the printer according to the first embodiment of the invention.
Figure 6B:
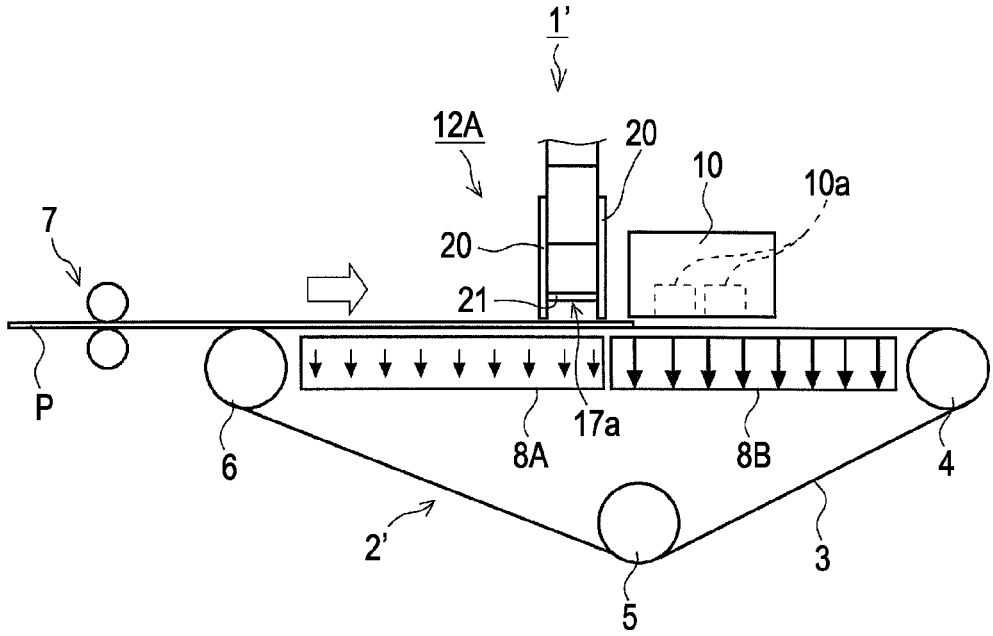
FIG. 6B is a side view showing the main portions of a printer according to a fifth embodiment of the invention.

1A is a side view showing the main portions of an ink jet printer (hereinafter, referred to as a "printer") 1 as a recording apparatus according to a first embodiment of the invention, FIG. 1B is a plan view thereof, FIG. 2 is a cross-sectional view of a drier 12A (first embodiment), FIG. 3 is a cross-sectional view of a drier 12B according to another embodiment (second embodiment), FIG. 4 is a cross-sectional view of a drier 12C according to another embodiment (third embodiment), FIG. 5 is a cross-sectional view of a drier 12D according to another embodiment (fourth embodiment), FIG. 6A is a side view showing the main portions of the printer 1 according to the first embodiment of the invention, and FIG. 6B is a side view showing the main portions of a printer 1' in which a transportation unit is replaced with another embodiment.

In addition, hereinafter, a direction (a vertical direction of FIG. 1B and a horizontal direction of FIG. 2 to 5) perpendicular to a sheet transportation direction (a horizontal direction of FIGS. 1A and 1B) is referred to as a "sheet width direction", for convenience of description.

First Embodiment

Hereinafter, a first embodiment of the invention will be described with reference to FIGS. 1 and 2.

The printer 1 according to the present embodiment is a so-called line head type high-throughput ink jet printer including an ink jet type recording head (recording unit) 10 with a length covering a sheet width, and ejects inks from the recording head 10 while moving a recording sheet P as an example of a recordable medium in a sheet transportation direction so as to execute recording, without reciprocally moving an ink ejecting head in the sheet width direction.

In more detail, the printer 1 has a gate roller 7 on the upstream side of a transportation unit 2. By the gate roller 7, skew is eliminated before feeding the recording sheet P to the transportation unit 2 and the recording sheet P is then fed to the transportation unit 2 disposed on the downstream side.

A transportation belt 3 which forms a transportation surface for transporting the recording sheet P and the transportation unit 2 including a plurality of rollers (a driving roller 4 and driven rollers 5 and 6), around which the transportation belt 3 is wound, are provided on the downstream side of the gate roller 7. The transportation belt 3 has a plurality of suction holes 3*a*. The recording sheet P is sucked by a suction device 8 through the suction holes 3*a* (in a direction denoted by an arrow of FIG. 1A), and is transported in a transportation direction with certainty.

The recording head 10 for ejecting inks is provided at a position facing the transportation surface of the transportation belt 3. In the recording head 10, a plurality of heads 10*a* is arranged in a zigzag shape in the sheet width direction. In each of the heads 10*a*, ink nozzles (not shown) of respective colors such as yellow, magenta, cyan and black are arranged so as to be shifted from each other in each of the colors in the transportation direction of the recording sheet P. The inks are supplied from ink tanks (not shown) of the respective colors to the ink nozzles (not shown) through ink supply tubes (not shown).

A necessary amount of ink droplets is ejected from the ink ejecting nozzles such that minute ink dots are formed on the recording sheet P. This operation is performed with respect to the respective colors and thus recording is completed by once passing the recording paper P sucked to the transportation belt 3.

Next, the drier 12A is provided in the vicinity of the upstream side of the recording head 10. The drier 12A, which includes a blast fan 18 and a heater 19, introduces outdoor air into the apparatus, heats the outdoor air to hot air (dried air), and sends the hot air to the inside of a case 13 through a taking-in port 16 of the case 13 as shown in FIG. 2.

The hot air is ejected from an ejection port 17*a* formed in the lower portion of the case 13 toward the recording sheet P so as to increase the temperature of the recording sheet P and evaporate residual moisture such that the drying after the inks are ejected is accelerated. In FIG. 2, the arrows denote the flow directions of the hot air in the respective portions.

Blades 20 functioning as a shielding member are provided on the transportation-direction upstream and downstream sides of the ejection port 17*a*. By the blades 20, the hot air ejected from the ejection port 17*a* is shielded so as not to be leaked in the sheet transportation direction and more particularly to the side (downstream side) of the recording head 10.

Accordingly, air including moisture emitted from the recording sheet P is not moved to the side of the recording head 10 or the movement thereof is reduced so as to prevent the recording head 10 or the peripheral configuration thereof from bedewing. If air including moisture flows in an opposite direction (upstream direction) of the recording head 10, the moisture may be absorbed by the recording sheet P again, but such a problem can be prevented.

A deflector 15 for spreading the received hot air in the sheet width direction is provided in the case 13, and a plurality of louvers (louver boards) 14A for regulating the ejection direction of the hot air is provided on the lower side thereof along the sheet width direction. An angle (hereinafter, referred to as an "inclined angle") between the board surface of each of the louvers 14A and the recording surface of the recording sheet P is substantially set to 90° such that the hot air is linearly ejected from the ejection port 17*a* onto the recording surface of the recording sheet P.

The drier 12A includes exhaust ports 17*b* in both ends thereof in the sheet width direction, in addition to the ejection port 17*a*. The flow rate of the hot air ejected from the ejection port 17*a* may be easily adjusted (reduced) by the exhaust ports 17*b*. In addition, a throttle (not shown) for adjusting the size of the opening of each of the exhaust ports 17*b* is provided such that the flow rate of the hot air ejected from the ejection port 17*a* can be adjusted with higher accuracy.

In addition, since the exhaust ports 17*b* disposed outside the sheet side end of the recording sheet P which are supposed to be used with a largest sheet width (are disposed outside the transportation belt 3) and are opened toward the outer direction of the sheet side end, it is possible to prevent turbulent flow of the hot air exhausted from the exhaust ports 17*b* from occurring at the peripheral end of the sheet and thereby prevent the sheet side end from floating (curling) by the turbulent flow.

Next, movable plates (shutter) 21 for covering the ejection port 17*a* are provided on both sides of the ejection port 17*a* in the sheet width direction. The movable plates 21 are slidably provided in the sheet width direction, and the hot air ejection range from the ejection port 17*a* can be adjusted according to the width dimension of the recording sheet P.

That is, if the width of the recording sheet P is large, the movable plates 21 are moved in the outer direction and, if the width is small, the movable plates 21 are moved in the center direction, such that the adequate hot air ejection range suitable for the width of the recording sheet P can be set. For example, the hot air ejection range may correspond to the width of the recording paper P. Accordingly, it is possible to prevent the turbulent flow of the hot air from occurring in a region deviating from the end of the sheet and to prevent the sheet side end from floating (curling) by the turbulent flow with certainty. In addition, it is possible to prevent the temperature of the preheated sheet (the recording sheet P is heated before recording) from being lowered by the turbulent flow.

Although one hot air drier 12A (ejection port 17*a*) is included in the above-described first embodiment, a plurality of hot air driers may be disposed on the sheet transportation direction such that the drying is accelerated by the plurality of hot air driers 12A (ejection ports 17*a*). In this case, the blade 20 interposed between two hot air driers 12A (ejection ports 17*a*) may be omitted.

Second Embodiment

Hereinafter, a second embodiment of the invention will be described with reference to FIG. 3. In addition, in the following embodiments including the present embodiment, the same configurations as the first embodiment described with reference to FIGS. 1 and 2 are denoted by the same reference numerals and the description thereof will be omitted.

In the drier 12B according to the present embodiment, the inclined angles of louvers 14B are set to be reduced (lie down to the paper) from the center to the end of the sheet width direction, and air stream is formed from the center to the side end of the sheet in the sheet width direction as denoted by arrows on the paper. Accordingly, air ejected from the drier 12B escapes from the sheet side end outwardly straight. Thus, it is possible to prevent turbulent flow from occurring in the sheet side end and to prevent the sheet side end from floating (curling).

Since air stream is formed from the center to the side end of the sheet width direction, it is possible to reduce the distance of the hot air from the sheet end outward direction after ejecting the hot air onto the recording sheet P. Accordingly, it is possible to rapidly separate air including moisture, which is emitted from the recording sheet P, from the recording sheet P, to suppress air including moisture from being moved to the downstream side; that is, the side of the recording head 10 even when the recording sheet P is transported at a high speed, and to prevent the recording head 10 or the peripheral configuration thereof from bedewing with certainty.

Third Embodiment

Hereinafter, a third embodiment of the invention will be described with reference to FIG. 4. The hot air drier 12C shown in FIG. 4 includes an edge regulating plate 22 for pressing the side end of a sheet. The edge regulating plate 22 is slidably provided in the sheet width direction, and an edge regulation position can be adjusted according to the width of the recording sheet P. Accordingly, even when the turbulent flow of hot air is generated in a region deviated from the end of the sheet, it is possible to prevent the sheet side end from floating (curling) by the turbulent flow with certainty. In addition, the edge regulating plate 22 is applicable to the above-described first and second embodiments or the following other embodiments.

Fourth Embodiment

Hereinafter, a fourth embodiment of the invention will be described with reference to FIG. 5. The hot air drier 12D shown in FIG. 5 includes a plurality of hot air units 23 and 24 as a blast source. Each of the hot air units individually includes a blast fan 18 and a heater 19, and can set the temperature of hot air and an ejection speed. Accordingly, it is possible to prevent the sheet side end from floating by setting the flow rate of the hot air from the hot air units 24 disposed at both ends of the sheet width direction to be slightly high.

The hot air unit 23 is fixedly provided at the center of the sheet width direction, and the hot air units 24 disposed at both ends of the sheet width direction are slidably provided in the sheet width direction. That is, since the hot air ejection range from the ejection port 17*a* can be adjusted according to the width of the recording sheet P, it is possible to prevent the turbulent flow of the hot air from occurring in a region deviating from the end of the sheet and to prevent the sheet side end from floating (curling) by the turbulent flow with certainty.

In addition, even when all the hot air units are fixedly provided, it is possible to prevent the sheet side end from floating by setting the flow rate of the hot air of the hot air units of both ends to be slightly high.

Fifth Embodiment

Hereinafter, a fifth embodiment of the invention will be described with reference to FIG. 6. FIG. 6A shows the printer 1 according to the above-described first embodiment and FIG. 6B shows a printer 1' according to the present embodiment in which the transportation unit 2 is replaced with another embodiment (transportation unit 2').

In FIG. 6A, the hot air ejected from the ejection port 17*a* of the drier 12A is prevented from being leaked to the upstream side and the downstream side of the transportation direction by the blade 20. However, if the hot air is leaked to the downstream side of the transportation direction and thus the turbulent flow is formed between the recording head 10 and the drier 12A, the front end of the recording sheet P floats as denoted by a reference numeral Ps and collides with the recording head 10 such that the recording surface is contaminated.

Accordingly, in the transportation unit 2' according to the present embodiment, as shown in FIG. 6B, a plurality of suction units 8A and 8B is disposed along the transportation direction, and the sheet suction force of the downstream suction unit 8B is set to be stronger than the sheet suction force of the upstream suction unit 8A.

The sheet suction of the downstream suction unit 8B is configured to be immediately performed after passing the drier 12A. Accordingly, even when the turbulent flow is formed between the recording head 10 and the drier 12A, it is possible to prevent the front end of the recording sheet P from floating by the turbulent flow and colliding with the recording head 10 and to prevent the recording surface from being polluted. By decreasing the sheet suction just below the drier 12A, it is possible to suppress the decrease in the temperature of the recording sheet P and to prevent the drying effect of the drier 12A from being lowered.

The above-described embodiments are portions of the embodiments of the invention, and the range of the invention is not limited thereto. Embodiments obtained by property combining the characteristic configurations of the embodiments may be employed.

What is claimed is:

1. A recording apparatus comprising:

a recording unit for performing recording on a recordable medium;

a transportation unit for transporting the recordable medium; and a drier for accelerating the drying of the recordable medium by ejecting gas onto the recordable medium, wherein the drier is configured such that the ejection range of the gas in a direction perpendicular to the transportation direction of the recordable medium is changeable, wherein in an air ejection port of the drier, a shutter member covering both sides of an ejection port in the direction perpendicular to the transportation direction is displaceably provided, and wherein the shutter member is displaceable such that the ejection range is changed.

2. The recording apparatus according to claim 1, wherein the drier forms an air stream from the center to the side end of the recordable medium in the direction perpendicular to the transportation direction of the recordable medium.

3. The recording apparatus according to claim 1, wherein:

the shutter member is displaceably provided in the direction perpendicular to the transportation direction.

4. The recording apparatus according to claim 1, wherein:

the drier includes a plurality of blast sources in the direction perpendicular to the transportation direction, and at least some of the plurality of blast sources are displaceable in the direction perpendicular to the transportation direction such that the ejection range is changed.

* * * * *